United States Patent [19]

Imam et al.

[11] 4,166,937

[45] Sep. 4, 1979

[54] HYDRAULICALLY-ACTIVATED OPERATING SYSTEM FOR AN ELECTRIC CIRCUIT BREAKER

[75] Inventors: Imdad Imam, Secane, Pa.; Philip Barkan, Stanford, Calif.

[73] Assignee: General Electric Company, Philadelphia, Pa.

[21] Appl. No.: 907,220

[22] Filed: May 18, 1978

[51] Int. Cl.[2] ..... H01H 35/38

[52] U.S. Cl. ..... 200/82 B; 200/148 B

[58] Field of Search ..... 60/413; 200/82 R, 82 B, 200/148 R, 148 B

[56] References Cited

U.S. PATENT DOCUMENTS

| | | | |
|---|---|---|---|
| 3,008,017 | 11/1961 | Strom | 200/82 B |
| 4,118,613 | 10/1978 | Barkan | 200/82 B |

*Primary Examiner*—Gerald P. Tolin

*Attorney, Agent, or Firm*—William Freedman; Carl L. Silverman

[57] ABSTRACT

This operating system comprises a fluid motor having a piston, a breaker-opening space at one side of the piston, and a breaker-closing space at its opposite side. An accumulator freely communicates with the breaker-opening space for supplying pressurized fluid thereto during a circuit-breaker opening operation. A normally-closed valve located on the breaker-closing-side of the piston is openable to release liquid from the breaker-closing space so that pressurized liquid in the breaker-opening space can drive the piston in an opening direction. Means is provided for restoring the valve to its closed position following the circuit-breaker opening operation. An impeded passage affords communication between the accumulator and the breaker-closing space to allow pressurized liquid to flow from the accumulator to the breaker-closing space and develop a pressure therein substantially equal to accumulator pressure when the valve is restored to closed position following breaker-opening. This passage is so impeded that the flow therethrough from the accumulator into the breaker-closing space is sufficiently low during initial opening motion of the piston through a substantial portion of its opening stroke as to avoid interference with said initial opening motion of the piston.

14 Claims, 2 Drawing Figures

16
12
14
10
34
24
20
36
22
17
30
ACCUMULATOR
39
80
83
38
50
32
TO SUMP
62a
65
62
42
82
64
40
76
56
37
60
41
68
90
70
75
74
72

16
12

14
34
20
17
36
30
39
83
38
80
50
TO SUMP
32
82
90
82a
62
65
64
40
42
76
37
60
D1
D2
90
68
74
70
75
72

HYDRAULICALLY-ACTIVATED OPERATING SYSTEM FOR AN ELECTRIC CIRCUIT BREAKER

The Government of the United States of America has right in this invention pursuant to Contract No. EX-76-C-01-2065 awarded by the U.S. Energy Research and Development Administration.

BACKGROUND

This invention relates to a hydraulically-actuated operating system for operating an electric circuit breaker and, more particularly, relates to rapid-response, relatively simple valve means and related valve-control means for controlling opening and closing of the circuit breaker.

The usual hydraulic operating system for producing very fast operation and control of a circuit breaker typically comprises a main valve and a pilot valve for controlling the main valve. Typically, the pilot valve must be operated from a normal to an operated position to initiate operation of the main valve, which, in turn, initiates operation of the circuit breaker, and must then return to its normal position at the end of the circuit-breaker operation to restore the main valve to its initial position so as to permit operation of the circuit breaker in a reverse direction. This type of pilot valve operation requires rather involved controls, either electrical or hydraulic. Moreover, the need to first operate the pilot valve tends to increase the time required from the initial starting signal to operation of the main valve.

SUMMARY

An object of our invention is to effect very fast circuit-breaker operation and control with a hydraulic operating system comprising a main valve that requires no pilot valve for its control and which requires only an initial starting pulse to produce very fast circuit-breaker operation followed by resetting of the main valve at the end of the circuit-breaker operation.

Typically, in prior hydraulic operating systems, the main valve referred to hereinabove is a three-way valve, which is generally more complicated and expensive than a comparable two-way valve. Instead of such three-way valve some systems use two two-way valves.

Another object is to carry out the preceding object with a hydraulic operating system that employs only a single two-way main valve and does not require a three-way main valve or a second two-way main valve.

Another object is to provide a hydraulic operating system that is capable of effecting especially short-response time opening of a circuit breaker following an initial starting signal.

In copending application Ser. No. 810,663 now U.S. Pat. No. 4,118,613, filed June 27, 1977, we have disclosed and claimed an operating system for achieving these objects which comprises a fluid motor having a piston, an accumulator of limited capacity, and a normally-closed control valve located between the fluid motor and the accumulator. When the control valve of that system is opened, pressurized liquid flows from the accumulator into a piston-actuating space in the fluid motor and drives the piston through a circuit-breaker opening stroke. A vent located hydraulically downstream of the valve from the accumulator acts after the opening stroke has been completed to reduce the pressure in the piston-actuating space and the accumulator, thus allowing the valve to reclose and also preparing the motor for a subsequent circuit breaker closing operation.

In the above-described operating system, a very rapid response in operating the piston has been achieved by rapidly moving the movable valve member of the control valve during the initial portion of a valve-opening stroke. But it is sometimes desirable to achieve even more rapid responses in operating the piston. We have discovered that one obstacle to achieving these more rapid responses is that most of the high pressure liquid that is initially released from the accumulator while the valve is opening acts to fill the cavity created in the wake of the rapidly-opening movable valve member. This cavity continues to be created until the movable valve member motion is retarded near the end of its opening stroke. The creation of this cavity causes a delay in the pressure build-up in the piston-actuating space, which, in turn, delays the opening operation of the fluid motor. While this effect usually is not of great importance, we have found it to be highly significant when operating at the exceptionally short response times obtainable with our operating system.

An object of our present invention is to substantially eliminate the above-described delay in circuit-breaker operation resulting from diversion of high pressure liquid into the above-described cavity formed in the wake of the rapidly-moving valve member.

The rapidity of response of a hydraulic operating mechanism usually depends directly upon the flow area of the control valve. But in the above-described operating system, if this flow area is increased, the size of the cavity formed in the wake of the rapidly-moving valve member is increased, thus diverting more liquid into the cavity, which can further delay operation of the fluid motor.

Another object of our invention is to provide an operating system in which the flow area of the valve can be increased without introducing delays as a result of a larger cavity in the wake of the rapidly-moving valve member.

Another object is to reduce delays in operation resulting from the presence of air bubbles in the operating liquid.

Still another object is to reduce the time needed to reset the operating system in preparation for a circuit-breaker closing operation immediately following an opening operation.

Still another object is to eliminate the need for recharging the accumulator after each opening operation, as is required in the above-described system which relies upon an accumulator of limited capacity.

In carrying out the invention in one form, we provide a fluid motor comprising a piston, a breaker-opening space on one side of the piston, and a breaker-closing space on the opposite side of the piston. An accumulator freely communicates with the breaker-opening space for supplying pressurized liquid thereto during the circuit-breaker opening operation. A normally-closed valve located on the breaker-closing-space side of the piston is openable to release liquid from the breaker-closing space so that pressurized liquid in the breaker-opening space can drive the piston in an opening direction. The valve comprises a movable valve member that is movable from a valve-closed position to a valve-open position to open the valve and is returnable to said valve-closed position to close the valve. Means is provided for returning the valve member to said valve-closed position following the circuit-breaker opening operation. An impeded passage affords communication between the accumulator and the breaker-closing space for allowing pressurized liquid to flow from the accumulator to the breaker-closing space and develop a pressure within said breaker-closing space substantially equal to accumulator pressure when said valve member is returned to said valve-closed position following a circuit-breaker opening operation. This passage is so impeded that the flow therethrough from said accumulator into said breaker-closing space is sufficiently low during initial opening motion of said piston through a substantial portion of its opening stroke as to avoid interference with said piston-opening motion during said initial opening motion of the piston.

The valve member during its opening motion develops a cavity in its wake that is rapidly filled by liquid released from said breaker-closing space by valve opening. This filling action accelerates the pressure drop in said breaker-closing space produced by valve opening, thereby decreasing the response time of the piston during an opening operation.

BRIEF DESCRIPTION OF DRAWINGS

For a better understanding of the invention, reference may be had to the accompanying drawings, wherein.

DETAILED DESCRIPTION OF PREFERRED EMBODIMENTS

Figure 1:
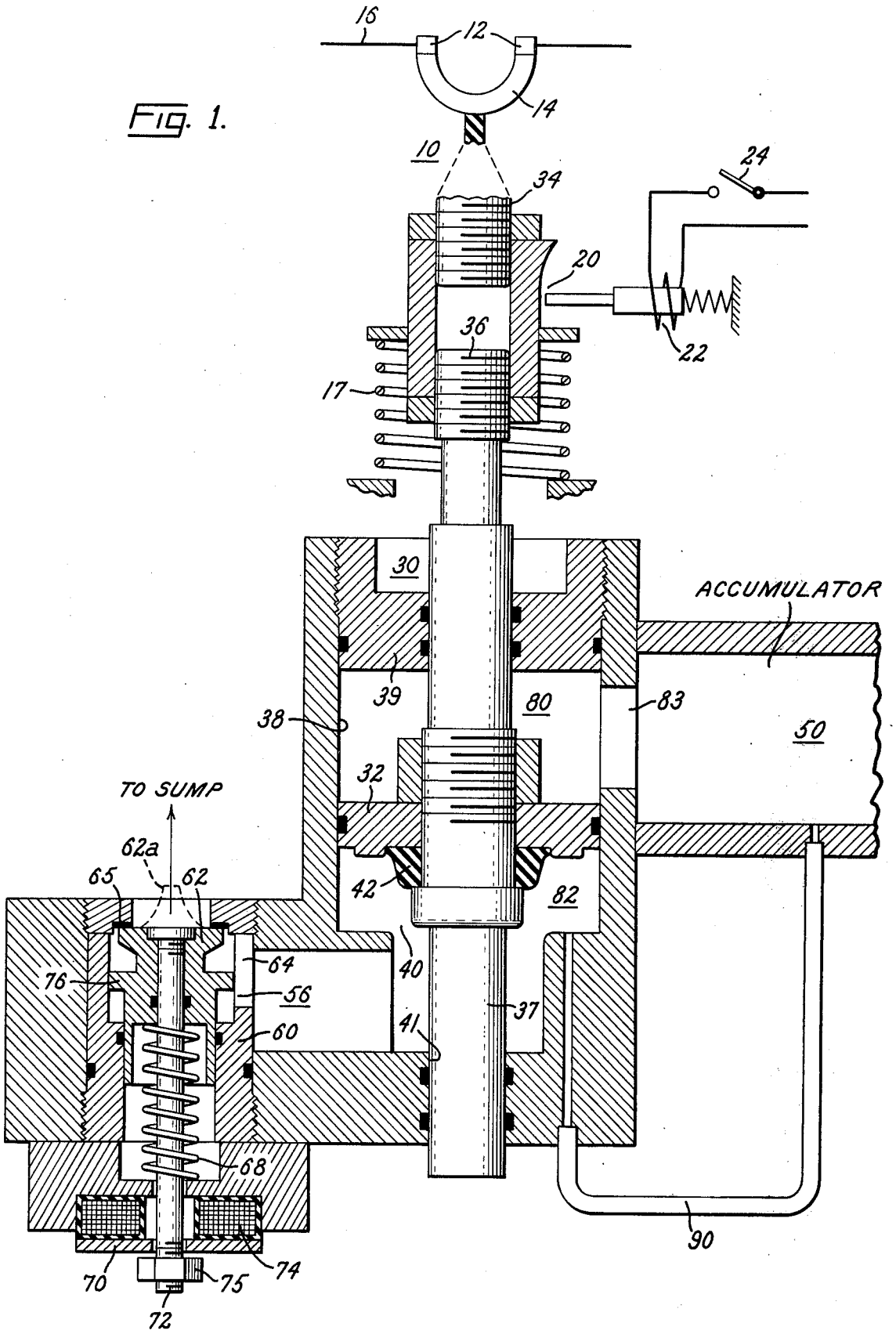
FIG. 1 is a partially schematic sectional view of a circuit breaker including a hydraulic operating system embodying one form of the invention. The circuit breaker is shown in its closed position, and the hydraulic operating system is shown in its normal at-rest condition in which it is prepared to initiate an opening operation of the circuit breaker.

Referring now to FIG. 1, there is shown a circuit breaker 10 comprising a set of separable contacts 12 and 14 for controlling a power circuit 16. The contacts 12 are stationary contacts, and the contact 14 is a movable contact that is adapted to be actuated by means of a fluid motor 30. Fluid motor 30, comprises a piston 32 coupled to movable contact 14 through an operating rod that has an insulating portion 34 and a metal portion 36 interconnecting the insulating portion and piston 32.

Fluid motor 30 further comprises a cylinder 38 within which piston 32 is vertically movable. The upper end of cylinder 38 is closed by an upper end wall 39 through which piston rod portion 36 slidably extends in sealed relationship. The lower end wall of cylinder 38 contains a central opening 40 through which a lower portion 37 of operating rod 34, 36 extends. A continuation of lower portion 37 extends downwardly through a sealed opening 41 in the cylinder wall to atmosphere. Movable contact 14 is biased into its closed position of FIG. 1 by a differential force acting in an upward direction on piston 32. In this regard, since the portion of piston rod 36 extending through upper end wall 39 is larger in cross-section than the lower piston rod portion 37 extending through opening 41, there is a net area of the piston structure exposed to upwardly-acting pressure. When the pressure on both sides of piston 32 is the same, which is the case when the circuit breaker is in its closed at-rest position of FIG. 1, there is a net force biasing the piston in an upward closing direction.

The cylinder space 80 at the upper side of piston 32 constitutes a breaker-opening space in which pressurized liquid can act on piston 32 to drive it downwardly from its position of FIG. 1 and, thus, open the circuit breaker. The cylinder space 82 at the opposite, or lower, side of piston 32 constitutes a breaker-closing space in which pressurized liquid acts on piston 32 in an upward, or circuit-breaker closing direction.

Pressurized fluid for driving piston 32 in a downward opening direction is derived from an accumulator 50 that freely communicates with breaker-opening space 80 through a minimum-length, large-diameter passage including a large port 83 in cylinder 38. Accumulator 50 is of a conventional design and has a capacity that allows it to supply pressurized liquid for several complete circuit-breaker opening and closing operations without requiring recharging. Charging of the accumulator is effected by reliance upon a pump (not shown) connected to the accumulator and controlled in a conventional manner.

The breaker-closing space 82 beneath piston 32 communicates with accumulator 50 through a long impeded passageway 90, which will soon be described in greater detail. When the circuit breaker is in its closed position of FIG. 1, breaker-closing space 82 is filled with pressurized liquid at accumulator pressure. Since the piston has a net area on which pressure acts in an upward direction, it would be apparent that with accumulator pressure on both sides of the piston, as in FIG. 1, there is a net force within fluid motor 30 biasing the circuit breaker into its closing position of FIG. 1.

Supplementing this upward closing bias is an additional closing force derived from a spring 17. In case pressure is inadvertently lost in the accumulator and, hence, in the fluid motor 30, this spring 17 will hold the circuit breaker contacts in closed position.

Figure 2:
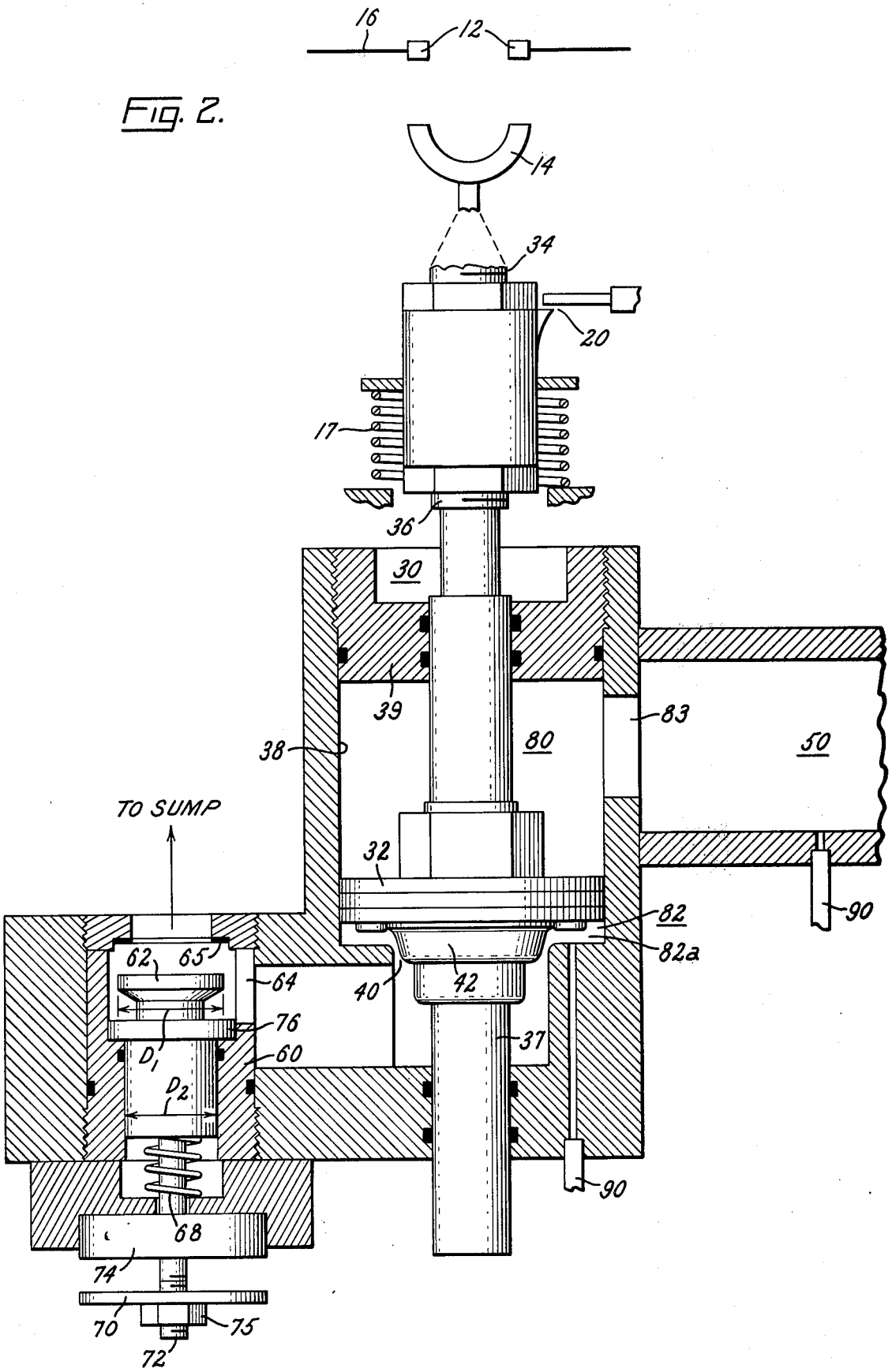
FIG. 2 is a view of the circuit breaker and hydraulic operating system of FIG. 1 at an instant near the end of a circuit-breaker opening operation but prior to resetting of the control valve of the system.

Located on the lower, or breaker-closing-space, side of the piston 32 is a normally-closed two-way control valve 56 that is openable to release pressurized liquid from the breaker-closing space 82 so that pressurized liquid in the breaker-opening space 80 above the piston can drive the piston 32 in a circuit-breaker opening direction. The control valve 56 comprises a cylindrical valve body 60 and a movable valve member 62 of the poppet type slidably mounted in the cylindrical valve body. The cylindrical valve body has a large port 64 extending therethrough and an annular valve seat 65 at its upper end against which the movable poppet valve member 62 seats when in its closed position. A compression spring 68 biases the movable valve member 62 upwardly into its closed position of FIG. 1, supplementing a slight hydraulic closing bias on the valve member 62 resulting from dimension $D_1$ of the movable main valve member 62 being slightly larger than $D_2$. These dimensions are best seen in FIG. 2.

For actuating the movable valve member 62, we provide a repulsion-type solenoid of a generally conventional design that comprises a stationary coil 74 and an armature 70 coupled to the movable valve member 62 through an operating rod 72. Armature 70 is a disc of highly conductive metal such as copper. The armature is normally held in close proximity to the stationary coil 74 by spring 68 and a nut 75 on rod 72. When the coil 74 is energized by a suitable pulse of current, it develops a magnetic field which induces eddy currents in the armature 70. These eddy currents generate a magnetic field which reacts with the magnetic field created by the coil to produce a rapidly rising repulsion force between the armature and the coil that quickly drives the armature downwardly (toward its position of FIG. 2) against the above-described opposing bias. This downward movement of armature 74 acts through nut 75 and operating rod 72 to drive movable valve member 62 downwardly from its position of FIG. 1.

Downward opening motion of valve member 62 from its closed position of FIG. 1 allows high pressure liquid in space 82 beneath piston 32 to immediately flow past the valve seat 65 to a low pressure sump, thus collapsing the pressure in space 82. The pressurized fluid flowing past the valve seat 65 makes a 90° turn in this region and thus has a momentum effect on the movable valve member 62 that acts in a downward direction on its upper face, thus rapidly providing a high downward force on valve member 62 that forces it downwardly at high speed once valve-opening has been initiated. When valve member 62 nears its position of FIG. 2 at the end of its downward opening stroke, a piston 76 thereon enters the closed end of the valve body, providing a dashpotting effect that smoothly terminates such opening movement of valve member 62.

As stated above, the piston 32 moves rapidly downward to open the circuit breaker in response to the drop in pressure in space 82 produced by the above-described opening of control valve 56. The plug 42 on the lower piston rod portion 37 is adapted to enter the opening 40 in the lower end wall of cylinder 38 as the piston rod nears the end of its downward opening stroke, thereby restricting the flow of liquid ahead of the downwardly-moving piston 32 through opening 40 and thus producing a dashpotting effect that smoothly terminates downward opening movement of the piston 32. FIG. 2 shows the part of the system while the piston is undergoing this dashpotting effect.

The movable valve member 62 remains open during the entire circuit-breaker opening stroke of piston 32 as a result of the above-described momentum effect of liquid flowing past the valve seat 65. But when downward motion of piston 32 is arrested, and the flow of fluid exiting through the valve 56 is terminated, this effect substantially ceases and the valve spring 68 is free to rapidly return movable valve member 62 upwardly into its closed position of FIG. 1. At the end of the piston stroke, the momentum of the fluid above valve member 62 results in the temporary creation of a void and very low pressure ahead of the then-closing valve member, which effectively augments the natural tendency of the valve member to close.

When movable valve member 62 is returned to its closed position of FIG. 1, pressure begins to build up within breaker-closing space 82, as a result of pressurized liquid entering the space 82 from the accumulator through restricted passage 90. But his pressure build-up in space 82 is restrained from initiating a closing operation because the circuit breaker is then being held open by a suitable hold-open latch 20 that had become effective at the end of the circuit-breaker opening operation.

Subsequent closing is effected by releasing the hold-open latch 20 to permit the pressurized liquid in space 82 beneath piston 32 to return movable contact 14 to its closed position. Although there is pressurized liquid above the piston at this time, the pressure beneath the piston is effective to produce closing because of the above-described net area of the piston exposed to upwardly-acting pressure. This release of latch 20 to initiate closing is effected by means of a solenoid 22 which is operated by completing an energizing circuit through its coil by closing a closing-control switch 24.

For a number of different reasons, the illustrated operating system is capable of initiating a circuit-breaker opening operation extremely rapidly. One of these reasons can best be understood by considering first our operating system disclosed in the aforesaid application Ser. No. 810,663. As pointed out in the introductory portion of the present specification, we have discovered that a factor limiting the rapidity of response in that system is the cavity formed in the wake of the rapidly-opening movable valve member, which valve member is then located between piston 32 and the accumulator. In that system, most of the high pressure liquid released from the accumulator when the valve is opened acts to fill this cavity and to accelerate opening of the movable valve member, and this delays operation of the piston. In the present operating system, while we also move the valve member 62 rapidly enough to develop a cavity in its wake, this cavity does not detract from the rapidity of response of our piston 32. As a matter of fact, in our present operating system, this cavity helps to reduce the pressure beneath the piston 32, and, by accelerating this pressure reduction, actually increases the rapidity of opening response of the piston 32.

In the system of our prior application, it is necessary to retard opening motion of movable valve member 62 after a short travel in order to prevent continued dissipation of pressurized liquid in accelerating the movable valve member, but such acceleration in the present system 80 aids, rather than interferes with, the desired change in pressure at the piston. Thus, there is less restraint on the manner in which the movable valve member 62 is retarded at the end of the stroke. In the present system movable valve member 62 can be dashpotted more smoothly over a longer distance.

The rapidity of response of a hydraulic operating system usually depends directly upon the flow area of the control valve. But in the operating system of our prior application Ser. No. 810,663, if this flow area is increased, the size of the above-described cavity in the wake of the rapidly-moving valve member is increased, thus diverting more liquid into the cavity, which tends to further delay operation of the main piston. But in the present system, the larger cavity which results from a larger movable valve member 62 accelerates the pressure drop beneath piston 32, thus contributing to more rapid response of the piston 32.

Another factor contributing to more rapid response in our present system is that at the start of the opening operation, liquid on both sides of the piston is already pressurized to the high pressure of the accumulator. This eliminates delays in opening due to the presence of air bubbles in the liquid, which effect is not very significant at these high pressures. This is in contrast to the type of system where liquid above the piston is initially at atmospheric pressure and must be compressed from atmospheric to accumulator pressure to effect piston operation. The known, much greater compressibility of gas at low pressure delays the response of the system significantly.

Another important feature of our present system is its short resetting time. One factor contributing to this is that the pressure of the liquid beneath piston 32 drops to substantially zero the instant that the piston stops moving at the end of its opening stroke. Indeed, negative pressures are created as a consequence of momentum of the fluid. This low pressure allows the control valve 56 to quickly reset under the influence of its reset spring 68. As soon as control valve 56 resets, closing can begin because the accumulator is already charged. In this latter regard, note that it is not necessary to rely upon an accumulator of limited capacity, as in our prior system. Even after an opening operation, our accumulator in the present system still has enough charge left to produce a multiple series of close-open operations should this be necessary.

To produce another opening operation immediately following a closing or reclosing operation, it is necessary merely to again open the control valve 56. This collapses the pressure beneath piston 32, allowing accumulator pressure above the piston to produce another opening operation, all in the same manner as described for the first opening operation.

Another feature of our system is that resetting of the system and reclosing of the circuit breaker can be achieved without any additional valves or controls for the valves beyond what has already been described. This is made possible by the presence of the long impeded passage 90 connecting the accumulator 50 and the breaker-closing space 82. This passage has the following functions:

1. In the closed position of the system, this passage 90 helps maintain the same pressure above and below the piston, which is equal to the accumulator pressure. Flow through passage 90 will also make up for any slight leakage from the control valve 56.

2. During the first half of the opening operation some liquid flows from the accumulator to the breaker-closing space 82 beneath piston 32 because pressure in this space drops as soon as the valve 56 opens. However, a relatively long time is needed for the liquid to accelerate through passage 90 because of the inertia and friction effects of the liquid in this relatively long, small diameter passage, and in the meantime (a few milliseconds) the operating system has already opened to the critical distance without any significant delay imposed by flow through the long restricted passage. (Note that the connection 83 between accumulator 50 and opening space 80 has deliberately been made very large in cross-section and very short in length so that no significant delay occurs to impair opening as a result of this passage). In the later half of the opening stroke, the piston 32 begins to dashpot as a result of plug 42 entering opening 40, as seen in FIG. 2, and accordingly pressure in the region 82*a* immediately below the piston begins to rise. This reverses the flow in the restricted passage 90. Now liquid flows from the breaker-closing space 82 of the cylinder to the accumulator 50. The main dashpotting area, which is designated 82*a* in FIG. 2, is designed in such a way that the extra liquid then flowing to the accumulator through passage 90 does not alter the dashpotting characteristics. Again the inertia of the long column and the short duration of the dashpotting interval minimize the influence of this passageway during the dashpotting interval. When the piston stops moving at the end of the opening stroke, pressure below the piston drops to zero. For a short, but significant, time liquid in the restricted passage 90 continues to flow from cylinder space 82*a* to the accumulator because of inertia effects of the liquid in the passage 90. This reverse flow in passage 90 is significant because it allows the valve 56 to reset automatically as there is little or no flow of liquid through the valve immediately after the piston stops moving at the end of the opening stroke. A further effect which assures the ability of the valve 56 to seat shortly after the piston motion is arrested is the momentum of the fluid under the piston. This momentum causes a low, in fact a negative, pressure to be created in space 82 when the piston 32 stops moving. Even when flow in the normal direction is restored in the impeded passage 90, pressure below the piston does not rise until the valve 56 has reset. This is because when the fluid motor is completely opened, the dashpot plug 42 almost completely blocks the dashpot orifice 40, and therefore pressure drop across the dashpotting region is significantly higher than across the opening through valve 56. This allows the valve to reset without any problem.

3. During the closing operation, passage 90 also acts to provide communication between the accumulator 50 and closing space 82, thus enabling sufficient pressure to be developed beneath the piston to continue the closing operation at the desired speed as the piston moves upwardly through its stroke. On closing, the time delay effected by long passage 90 is not significant because closing of this circuit breaker is deliberately made slow for diverse reasons. If faster closing is desired, passage 90 can be made shorter or larger in cross-section, provided the resultant decrease in opening speed can be tolerated in the particular application that is involved.

In the drawings, the interrupting portion of the circuit breaker (i.e., contact structure 12, 14) has been shown schematically only. In a preferred form of the invention, this interrupting structure is constituted by one or more vacuum-type circuit interrupters, such as disclosed for example in U.S. Pat. Nos. 3,462,572—Sofianek or 3,246,979—Lafferty et al. It is to be understood, however, that our invention in its broader aspects is not limited to use in operating systems for vacuum interrupters. It may also be used with other types of interrupters, such as oil interrupters or gas blast interrupters, including those of the puffer type, such as shown for example in U.S. Pat. Nos. 3,739,125—Noeske or 3,602,670—Teijeiro.

Our operating system when used with one or more vacuum interrupters does, however, have the capability of achieving opening times of one-half cycle or even less of a 60 Hertz current wave. Such exceptionally rapid response enables us to use our operating system in a vacuum circuit breaker to achieve current-limiting interrupting action, or first current-zero interruption, or the exceptionally fast performance needed for typical high voltage d.c. circuit breakers of the commutated-capacitor type.

Typically, non-vacuum interrupters have a much longer stroke than vacuum interrupters; and when our operating system is used for such non-vacuum interrupters, its exceptional speed will permit attainment of ratings of 2 cycles or less. In such applications, the passage 90 is made longer so as to further delay the flow of substantial amounts of pressurized liquid therethrough into the space 82 beneath the piston 32 following the start of an opening operation. In these non-vacuum interrupter applications, such flow is delayed until the piston 32 has moved through a substantial portion of its opening stroke, e.g., about 20 percent, so as to give sufficient opportunity for the piston to have been accelerated to an effective opening speed. This substantial flow through passage 90 into space 82 occurs after the valve member 62 has reached its fully open position so that back pressure under the piston is extremely small as a consequence of the flow. Thus, there is little reduction in either opening speed or in rapidity of response as a consequence of passage 90, provided only that the flow impedance of passage 90 is substantially greater than the flow impedance of the exhause passage through the valve 56.

By way of example and not limitation, we have utilized a passageway 90 having a length of 25 inches and a diameter of $\frac{5}{8}$ inch in a hydraulic operator corresponding to that illustrated and used for operating vacuum interrupters having a stroke of $\frac{5}{8}$ inch. Exceptionally short opening times of about $3\frac{1}{2}$ milliseconds were achieved with this operating system, which corresponded in overall configuration to the operating system disclosed and claimed in our application Ser. No. 814,429, filed Oct. 12, 1977. These short opening times were achieved despite the fact that relatively long operating rods of about 30 inches were present between the interrupters and the hydraulic operator.

It was pointed out hereinabove, in connection with circuit-breaker opening, that flow past valve seat 65 produces a momentum effect on movable valve member 62 that acts in a downward direction on its upper face, thus rapidly providing a high downward force on valve member 62 that accelerates downward movement once valve-opening has been initiated. This momentum effect on the movable valve member can be accentuated and made more efficient by providing a tapered projection on the upper end of the movable valve member, shown in dotted lines at 62*a* in FIG. 2. This projection guides the flow more smoothly through its 90 degree turn in this region.

Although the illustrated operating system is used for achieving an exceptionally high rate of response on circuit-breaker opening, our invention in its broader aspects comprehends use of this operating system for achieving this high rate of response on closing instead of opening. This can be achieved simply by altering the contacts of the circuit breaker so that they are fully open when the operating system is in its conditions of FIG. 1 and are closed when the operating system is in its condition of FIG. 2.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. In a hydraulically-actuated operating system for an electric circuit breaker, (a) a fluid motor comprising a cylinder and a movable piston adapted to move in an opening direction within said cylinder to open said circuit breaker and in a reverse direction within said cylinder to close the circuit breaker, the cylinder space at one side of said piston constituting a breaker-opening space in which pressurized liquid can act on said piston to open said circuit breaker and the cylinder space at the opposite side of said piston constituting a breaker-closing space in which pressurized liquid can act on said piston to close said circuit breaker, (b) an accumulator freely communicating with said breaker-opening space for supplying pressurized liquid thereto during a circuit-breaker opening operation, (c) a normally-closed valve located on the breaker-closing-space side of said piston and openable to release liquid from said breaker-closing space so that pressurized liquid in said breaker-opening space can drive said piston in an opening direction, said valve comprising a movable valve member that is movable from a valve-closed position to a valve-open position to open said valve and is returnable to said valve-closed position to close said valve, (d) means operable in response to the pressure in the breaker-closing space dropping to a predetermined level for returning said valve member to said valve-closed position following a circuit-breaker opening operation, (e) means for causing the pressure in the breaker-closing space to drop to said predetermined level immediately after piston motion in an opening direction is terminated, (f) and an impeded passage affording communication between said accumulator and said breaker-closing space for allowing pressurized liquid to flow from said accumulator to said breaker-closing space and develop a pressure within said breaker-closing space substantially equal to accumulator pressure when said valve member is returned to said valve-closed position following a circuit-breaker opening operation, said passage affording communication between said accumulator and said breaker-closing space during opening motion of said piston but being so impeded that the flow therethrough from said accumulator into said breaker-closing space is sufficiently low during initial opening motion of said piston through a substantial portion of its opening stroke as to avoid interference with said piston motion during said initial opening motion of the piston.

2. The operating system of claim 1 in which:

(a) said piston occupies a circuit-breaker closed position when the circuit breaker is closed and a circuit-breaker open position when the circuit breaker is open, (b) releasable latching means is provided for holding said piston in said circuit-breaker open position after a circuit-breaker opening operation, and (c) release of said latching means allows the pressure within said breaker-closing space to drive said piston from said circuit-breaker open position to said circuit-breaker closed position.

3. The operating system of claim 1 in which: said valve member during its opening motion develops a cavity in its wake that is rapidly filled by liquid released from said breaker-closing space by valve opening, thereby accelerating the pressure drop in said breaker-closing space produced by valve opening.

4. The operating system of claim 1 in which:

(a) the momentum effect of flow through said valve upon initial valve-opening is in a direction to accelerate valve-opening motion of said valve member, (b) said movable valve member seats against an annular valve seat when the valve is closed, and (c) said valve member has a tapered projection extending through and beyond said valve seat for guiding flow more smoothly past said movable valve member during initial opening motion of the valve member, thereby improving the efficiency of the momentum effect in accelerating valve-member opening motion.

5. The operating system of claim 1 or 3 in which the momentum of the pressurized liquid flowing through said valve upon initial valve-opening is in a direction to accelerate valve-opening motion of said valve member.

6. The operating system of claim 1 or 3 in which:

(a) means is provided for trapping liquid in a region of said breaker-closing space ahead of said piston during the latter half of the piston's circuit-breaker opening motion, thereby producing a pressure build-up in said region near the end of the piston's circuit-breaker opening motion that provides dashpotting action on said piston, (b) said impeded passage enters said breaker-closing space in said region, (c) said impeded passage is of such a size and length that:

(i) during the first half of opening motion of said piston a small amount of pressurized liquid flows from said accumulator into said breaker-closing space, (ii) flow through said passage reverses when pressure builds up in said region during said dashpotting action, (iii) pressure in said region drops sharply when circuit-breaker opening motion of said piston is terminated, and (iv) despite said sharp drop in pressure the inertia effect of liquid flowing in said reverse direction through said passage causes said liquid to continue flowing in said reverse direction until said valve member returns to substantially its valve-closed position.

7. The operating system of claim 1 or 3 in which:

(a) means is provided for trapping liquid in a region of said breaker-closing space ahead of said piston during the latter half of the piston's circuit-breaker opening motion, thereby producing a pressure build-up in said region near the end of the piston's circuit-breaker opening motion that provides dashpotting action on said piston, (b) said impeded passage enters said breaker-closing space in said region, (c) said impeded passage is of such a size and length that:

(i) during the first half of opening motion of said piston a small amount of pressurized liquid flows from said accumulator into said breaker-closing space, (ii) flow through said passage reverses when pressure builds up in said region during said dashpotting action, (iii) pressure in said region drops sharply when circuit-breaker opening motion of said piston is terminated, and (iv) the momentum effect of liquid flowing from said closing space causes the closing space to be maintained at very low pressure until said valve member returns to its valve-closed position.

8. The operating system of claim 1 in which the flow impedance of said impeded passage is substantially greater than the flow impedance of the exhaust passage through said valve.

9. The operating system of claim 1 in which said impeded passage is so highly impeded that flow therethrough is sufficiently low immediately after piston motion in an opening direction has terminated that such flow does not interfere with return of said valve member to said valve-closed position immediately after such piston-motion termination.

10. In a hydraulically-actuated operating system for an electric circuit breaker operable in a closing sense and an opening sense, (a) a fluid motor comprising a cylinder and a movable piston adapted to move in one direction within said cylinder to operate said circuit breaker in one of said senses and in a reverse direction within said cylinder to operate the circuit breaker in the other of said senses, the cylinder space at one side of said piston constituting a first breaker-operating space in which pressurized liquid can act on said piston to operate said circuit breaker in said one sense and the cylinder space at the opposite side of said piston constituting a second breaker-operating space in which pressurized liquid can act on said piston to operate said circuit breaker in said other sense, (b) an accumulator freely communicating with said first breaker-operating space for supplying pressurized liquid thereto during a circuit-breaker operation in said one sense, (c) a normally-closed valve located on the second breaker-operating space side of said piston and openable to release liquid from said second breaker-operating space so that pressurized liquid in said first breaker-operating space can drive said piston in said one direction, said valve comprising a movable valve member that is movable from a valve-closed position to a valve-open position to open said valve and is returnable to said valve-closed position to close said valve, (d) means operable in response to the pressure in said second breaker-operating space dropping to a predetermined level for returning said valve member to said valve-closed position following a circuit-breaker operation in said one sense, (e) means for causing the pressure in said second breaker-operating space to drop to said predetermined level immediately after piston motion in said one direction is terminated, (f) and an impeded passage affording communication between said accumulator and said second breaker-operating space for allowing pressurized liquid to flow from said accumulator to said second breaker-operating space and develop a pressure within said second breaker-operating space substantially equal to accumulator pressure when said valve member is returned to said valve-closed position following a circuit-breaker operation in said one sense, said passage affording communication between said accumulator and said second breaker-operating space during motion of said piston in said one direction but being so impeded that the flow therethrough from said accumulator into said second breaker-operating space is sufficiently low during initial motion of said piston in said one direction through a substantial portion of its operating stroke as to avoid interference with said piston motion in said one direction during said initial motion of the piston in said one direction.

11. The operating system of claim 1 in which said impeded passage affords uninterrupted communication between said accumulator and said breaker-closing space during a breaker-opening operation of said piston.

12. The operating system of claim 1 or 3 in which:

(a) the momentum of the pressurized liquid flowing through said valve upon initial valve-opening is in a direction to accelerate valve-opening motion of said valve member, (b) said momentum acts in a direction to keep said valve member open while liquid is flowing through said valve from said breaker-closing space during the breaker-opening stroke of said piston, and (c) said momentum effect substantially ceases when piston motion is terminated at the end of its breaker-opening stroke.

13. The operating system of claim 12 in which said impeded passage is so highly impeded that flow therethrough is sufficiently low immediately after piston motion in said one direction has terminated that such flow does not interfere with return of said valve member to said valve-closed position immediately after such piston-motion termination.

14. The operating system of claim 10 in which said impeded passage affords uninterrupted communication between said accumulator and said second breaker-operating space during motion of said piston in said one direction.

* * * * *